US006228182B1

(12) United States Patent
Nakano et al.

(10) Patent No.: US 6,228,182 B1
(45) Date of Patent: May 8, 2001

(54) METHOD AND LOW IRON LOSS GRAIN-ORIENTED ELECTROMAGNETIC STEEL SHEET

(75) Inventors: Koh Nakano; Atsuhito Honda; Keiji Sato, all of Okayama (JP)

(73) Assignee: Kawasaki Steel Corporation (JP)

( * ) Notice: Subject to any disclaimer, the term of this patent is extended or adjusted under 35 U.S.C. 154(b) by 0 days.

(21) Appl. No.: 08/365,313

(22) Filed: Dec. 28, 1994

Related U.S. Application Data

(63) Continuation of application No. 08/101,971, filed on Aug. 4, 1993, now abandoned.

(30) Foreign Application Priority Data

Aug. 5, 1992 (JP) ..... 4-209037

(51) Int. Cl.[7] ..... C21D 9/46

(52) U.S. Cl. ..... 148/111; 148/112; 148/113; 148/308

(58) Field of Search ..... 148/111, 112, 148/113, 120, 308

(56) References Cited

U.S. PATENT DOCUMENTS

| | | | | |
|---|---|---|---|---|
| 3,647,575 | * | 3/1972 | Fiedler | 148/111 |
| 4,737,203 | * | 4/1988 | Shen et al. | 148/111 |
| 4,750,949 | * | 6/1988 | Kobayashi et al. | 148/111 |
| 4,863,531 | * | 9/1989 | Wada et al. | 148/113 |
| 4,904,313 | * | 2/1990 | Ames et al. | 148/113 |
| 4,975,127 | * | 12/1990 | Kurosawa et al. | 148/111 |
| 5,185,043 | * | 2/1993 | Nishike et al. | 148/113 |

FOREIGN PATENT DOCUMENTS

| | | | | |
|---|---|---|---|---|
| 54-23647 | * | 8/1979 | (JP) . | |
| 60-255926 | * | 12/1985 | (JP) . | |
| 62-53579 | * | 4/1986 | (JP) . | |
| 63-76819 | * | 4/1988 | (JP) . | |
| 2-30718 | * | 2/1990 | (JP) | 148/111 |
| 4-88121 | * | 3/1992 | (JP) | 148/111 |

* cited by examiner

*Primary Examiner*—Sikyin Ip
(74) *Attorney, Agent, or Firm*—Austin R. Miller

(57) ABSTRACT

A method and a low iron loss grain-oriented electromagnetic steel sheet are disclosed. The method comprises the steps of: hot-rolling a grain-oriented electromagnetic steel sheet; cold-rolling the hot-rolled steel sheet once or twice intervened by intermediate annealing, so as to achieve the sheet thickness of a final product; annealing the cold-rolled steel sheet for decarburization; finish-annealing the decarburized steel sheet; forming linear grooves on the steel sheet substantially perpendicularly to the rolling direction, after the final cold-rolling step and before the finish-annealing step, by, for example, electrolytic etching or acid dipping; and filling the linear grooves with an element selected from the group consisting of Sn, B and Sb, or an oxide or a sulfate of an element selected therefrom. Preferably, each of the linear grooves has a width of 30–300 μm and a depth of 5–100 μm, and extends at 60–90° to the rolling direction, and is apart from the adjacent groove by 1 mm measured parallel to the rolling direction.

20 Claims, 4 Drawing Sheets

METHOD AND LOW IRON LOSS GRAIN-ORIENTED ELECTROMAGNETIC STEEL SHEET

This application is a continuation of application Ser. No. 08/101,971, filed Aug. 4, 1993, now abandoned.

BACKGROUND OF THE INVENTION

1. Field of the Invention

The present invention relates to a method of producing a grain-oriented electromagnetic steel sheet having excellent magnetic characteristics and, more particularly, to a low iron loss grain-oriented electromagnetic steel sheet suitable for a material of iron cores used in transformers and other electric devices.

2. Description of the Related Art

A grain-oriented electromagnetic steel sheet for iron cores employed in transformers and other electric devices must have good magnetic characteristics and, particularly, a low iron loss. Iron loss is substantially the sum of hysteresis loss and eddy current loss. According to the conventional art, hysteresis loss is significantly reduced by, for example, using an inhibitor to highly integrate the crystal orientation in the Goss direction, that is, the (110)<001> direction, and reducing impurity elements which give rise to the pinning factor of the domain wall shift during magnetization. Eddy current loss can be reduced by many methods, such as increasing the Si content so as to increase the electric resistance of the steel sheet, reducing the thickness of the steel sheet, coating the surface of the base metal of the steel sheet with a coat having a coefficient of expansion different from that of the base metal to provide a tension for the base metal, and/or reducing the grain size so as to reduce the domain width.

Other methods for further reducing the eddy current loss have recently been disclosed, in which a steel sheet is grooved. The methods of forming these grooves can be divided into two main groups: methods in which grooves are locally formed on a steel sheet after the finishing annealing, that is, the secondary recrystallization, so as to achieve the demagnetization effect that reduces the domain size; other methods in which such grooves are formed on a steel sheet before the finishing annealing.

The former group of methods employs various processes for forming such grooves. For example, a process is disclosed in Japanese Patent Publication No. 50-35679 in which grooves are mechanically formed. Another process is disclosed in Japanese Patent Laid-open No. 63-76819 in which an insulating coat and a primary coat of a steel sheet are locally removed by laser irradiation followed by electrolytic etching. Still another process is disclosed in Japanese Patent Publication No. 62-53579 in which grooves are impressed on a steel sheet by a gear-shape roll and then annealed for removing the stress. However, the mechanical process and the process using a gear-shape roll form large amounts of burrs adjacent to the grooves, thereby significantly degrading the space factor of a final product such as a transformer.

Further, because the process in which the coating of the steel sheet is partially removed by laser irradiation followed by electrolytic etching after the secondary recrystallization requires another step of coating the steel sheet after the grooves have been formed by electrolytic etching, the coating thickness is increased, thereby degrading the space factor, increasing production costs and reducing productivity.

One method of the latter group in which a steel sheet is grooved before finishing annealing is disclosed in Japanese Patent Laid-open No. 59-197520. This method is free of the above-stated drawbacks, but fails to achieve a reduction in iron loss that meets present needs.

To achieve a reduction in iron loss greater than those achieved by the above methods, Japanese Patent Laid-open Nos. 60-255926 and 61-117284 propose a method in which after a finish-annealed steel sheet is irradiated with a laser beam to locally remove the insulating coat and/or primary coat and then etched to form grooves, the grooves are filled with a substance different from the steel of the steel sheet.

However, this method also requires another step of coating the steel sheet after the grooves have been filled, thereby degrading the space factor of the product, increasing production costs and reducing productivity.

Japanese Patent Publication No. 54-23647 discloses a method in which some regions are processed so as to inhibit grain growth during secondary recrystallization. These regions are formed by processing a steel sheet after cold rolling or annealing for decarburization by a mechanical process, such as shot peening, a thermal process using an electron beam or the like, or a chemical process utilizing diffusion of, for example, S, Al, Se and Sb. This method enhances the magnetic flux density and reduces iron loss by directly controlling secondary crystallization. However, in industrial-scale production, the mechanical process, such as shot peening, will not easily introduce uniform stress into a steel sheet, and the thermal process using an electron beam or the like will require a large apparatus and, thus, increases production costs.

Although the mechanical process has advantages in that the compounds of S, Al, Se or Sb can be applied to a steel sheet at a low cost by, for example, high-speed printing, this process also has problems. For example, while a steel sheet is being conveyed at a high speed, the substance applied thereto may well be blown off, causing variations in the amount of the remaining substance. Further, the substance applied to a steel sheet is liable to rub off while the steel sheet is being coiled up. No matter which of the processes is employed, this method causes a large dispersion of the magnetic characteristics of the products.

Japanese Patent Publication No. 63-1372 discloses a method in which, prior to finishing annealing, a surface of a steel sheet is locally processed and a dilute aqueous solution is applied thereto so as to control the secondary recrystallization rate. The local surface processing is plastic processing by using a ridged roll or irradiation with an electron beam or a laser beam so as to introduce stress which promotes diffusion of the substance applied thereto. However, the stress thus introduced is non-uniform and, therefore, causes non-uniform diffusion of the substance, resulting in variations in the magnetic characteristics.

SUMMARY OF THE INVENTION

The present invention is intended to solve the above-stated problems. An object of the present invention is to provide a method of producing a grain-oriented electromagnetic steel sheet having low iron loss with consistent quality at low cost.

As a result of study and experiments for developing a method of producing a low iron loss grain-oriented electromagnetic steel sheet with consistent quality at low cost, the present inventors have found that a reduction in iron loss greater than the reduction therein made by the prior art can be achieved by locally etching a final cold-rolled sheet to form grooves, and filling the grooves with an element selected from the group consisting of Sn, B and Sb, or an oxide or a sulfate of the selected element.

The present invention provides a method of producing a low iron loss grain-oriented electromagnetic steel sheet, which includes the steps of:

hot-rolling a grain-oriented electromagnetic steel sheet;

cold-rolling the hot-rolled steel sheet once or at least two times, including intermediate annealing, so as to achieve the sheet thickness of a final product;

annealing the cold-rolled steel sheet for decarburization;

finish-annealing the decarburized steel sheet;

forming linear grooves on the steel sheet by a method selected from the group consisting of an electrochemical and a chemical method, the grooves extending substantially perpendicularly to the rolling direction, after the final cold-rolling step and before the finish-annealing step, by an electrochemical method, such as electrolytic etching, and a chemical method, such as acid dipping; and filling the linear grooves with an element or compound of the element, the element being selected from the group consisting of Sn, B and Sb. The compound may be an oxide or a sulfate, for example.

According to this invention, the iron loss can be maximally reduced by forming each of such linear grooves so as to have a width of about 30–300 $\mu$m and a depth of about 5–100 $\mu$m, and to extend at about 60–90° to the rolling direction, and to be spaced from the adjacent groove by about 1 mm.

The silicon-containing steel used as a material according to the present invention may have any composition according to the prior art. An example silicon steel has the following contents:

about 0.01–0.10 wt % (i.e., % by weight, and hereinafter referred to simply as "%") carbon. Carbon promotes development of the Goss orientation as well as formation of a uniform and fine structure during hot rolling and cold rolling. The carbon content is preferably at lowest about 0.01%, but at highest preferably about 0.10% because a carbon content higher than 0.10% may disturb the Goss orientation;

about 2.0–4.5% silicon. Silicon enhances the specific resistance and reduces the iron loss of a steel sheet. However, a silicon content higher than about 4.5% may degrade the cold rolling characteristics of the steel, and a content lower than about 2.0% reduces the specific resistance of the steel sheet and, further, fails to sufficiently reduce the iron loss because such a low silicon content causes the $\alpha$-$\gamma$ transformation during the final high-temperature annealing for the secondary recrystallization and purification, and results in random crystal orientation. Thus, the silicon content is preferably about 2.0–4.5%.

about 0.02–0.12% manganese; A manganese content of preferably at lowest about 0.02% is needed to prevent hot embrittlement. A preferable upper limit is about 0.12% because a content higher than about 0.12% is likely to degrade the magnetic characteristics of the steel sheet.

The silicon steel contains an inhibitor of a so-called MnS, MnSe or AlN type.

To employ a MnS and/or MnSe type inhibitor, at least one of Se and S is added in an amount within a range of about 0.005–0.06%. Se and S effectively control the secondary recrystallization of a grain-oriented silicon steel sheet. A content of at least about 0.005% is needed to provide a sufficiently strong inhibitory effect, but a content higher than about 0.06% may lose such an effect. Thus, the preferable lower and upper limits are about 0.001% and 0.06%.

To employ an AlN type inhibitor, aluminum and nitrogen are added in amounts within ranges of about 0.005–0.10% and about 0.004–0.015%, respectively. These ranges of the Al and N contents are determined based on the same reasons as stated above. It should be noted that a MnS and/or MnSe type inhibitor and an Al type inhibitor may be applied separately or in combination.

Besides S, Se and Al, other elements, such as Cu, Sn, Cr, Ge, Sb, Mo, Te, Bi or P, are also suitable inhibitor components. The silicon steel sheet of the present invention may contain, in addition to S, Se or Al, about 0.01–0.15% of Cu, Sn or Cr, or about 0.005–0.1% of Ge, Sb, Mo, Te or Bi, or 0.01–0.2% P. These elements may be applied either separately or in combination.

DETAILED DESCRIPTION OF THE INVENTION

The present invention will be described in detail hereinafter. First, the experiments on which the present invention is based will be described.

[First Experiment]

A grain-oriented electromagnetic steel slab containing 3.40% silicon was heated and hot-rolled, and then cold-rolled to obtain a steel sheet having a thickness of 0.23 mm.

The steel sheet was rolled by a ridged roll or irradiated with an electron beam to form linear grooves extending perpendicularly to the rolling direction and each spaced from the adjacent one by about 5 mm. The grooves were coated with a slurry of $SnO_2$ and water. Then, the steel sheet was annealed for decarburization and then finish-annealed. The thus-formed steel sheet was sheared into sample sheets. The magnetic characteristics of the samples were determined.

Comparative sample steel sheets having no groove and no $SnO_2$ coating were obtained from the-final cold-rolled steel sheet coil used for obtaining the above-mentioned sample sheets, more specifically, from portions adjacent to the portions cut out for the sample sheets. The magnetic characteristics of these comparative samples were also determined, and were evaluated with respect to the iron loss $W_{17/50}$ (W/kg) and the magnetic flux density B8(T).

Figure 1:
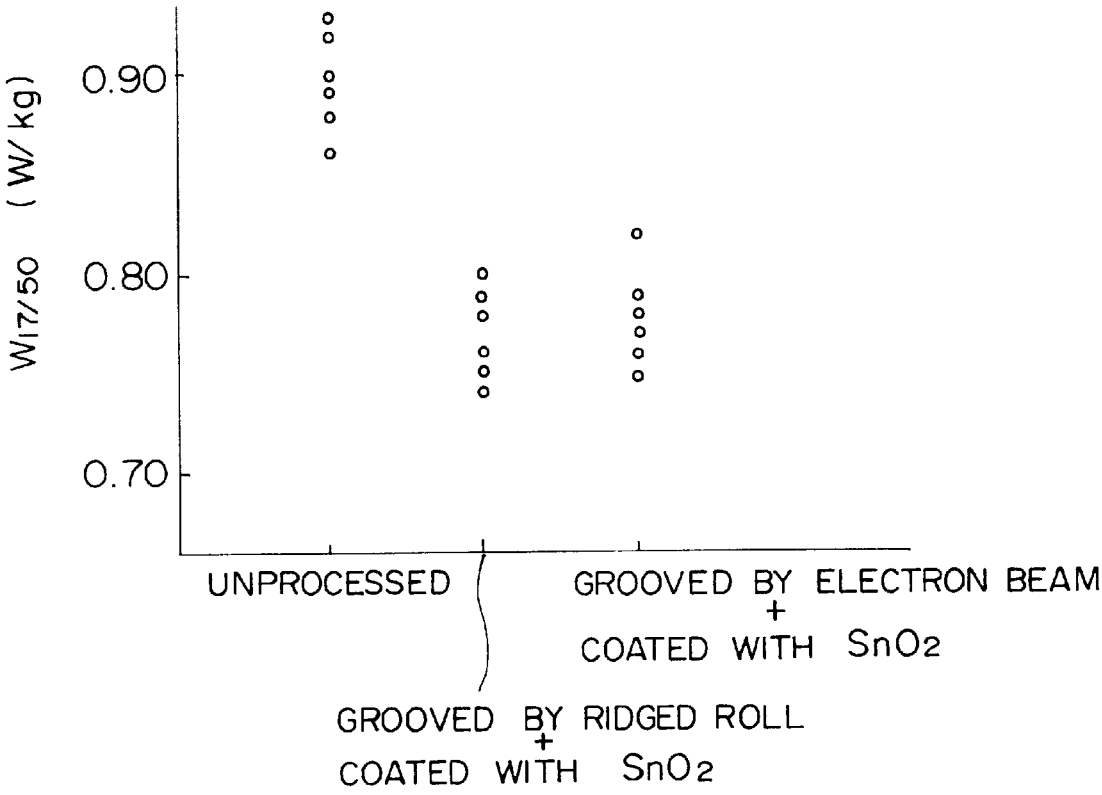
FIG. 1 is a graph showing the results of a first experiment according to the present invention and, more specifically, the iron loss characteristics of sample steel sheets provided with grooves which have been formed by a ridged roll or an electron beam and coated with $SnO_2$ and sample steel sheets provided with no groove and no $SnO_2$ coating.
Figure 2:
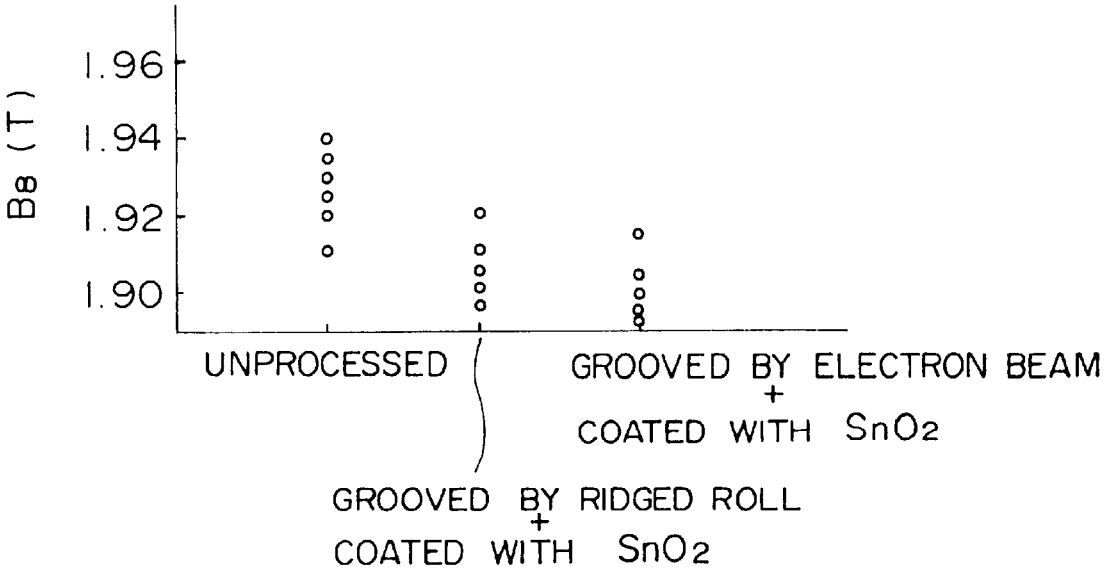
FIG. 2 is a graph showing the results of a first experiment according to the present invention and, more specifically, the magnetic flux density of sample steel sheets provided with grooves which have been formed by a ridged roll or an electron beam and coated with $SnO_2$ and sample sheets provided with no groove and no $SnO_2$ coating.

The results are shown in FIG. 1 and FIG. 2. As shown in FIG. 1, the samples having grooves formed by a ridged roll or an electron beam and $SnO_2$ slurry coating had very unstable iron loss characteristics $W_{17/50}$ (W/kg).

[Second Experiment]

A grain-oriented electromagnetic steel slab containing 3.40% silicon was heated and hot-rolled, and then cold-rolled to obtain a steel sheet having a thickness of 0.23 mm. Then, an etching-resist ink was applied to the steel sheet so as to leave linear uncoated areas which extended substantially perpendicularly to the rolling direction and had a width of 0.2 mm and a gap of 3 mm therebetween. Subsequently, the steel sheet was electrolytically etched so as to form linear grooves having a depth of 20 $\mu$m. The application of the resist ink was performed by photogravure offset printing using a gravure ink containing an alkoxide resin as a main component. The electrolytic etching was performed in a NaCl aqueous solution under the conditions where the electric current density was 10 A/dm$^2$ and the electrolysis time was 20 seconds.

The grooves were electroplated with Sn in a plating bath containing 60 g of stannous sulfate, 80 g of sulfuric acid, 100 g of cresolsulfonic acid, 1.0 g of β-naphthol and 2 g of gelatin per 1 liter of ion-exchanged water, at a bath temperature of 30° C., for 5–20 seconds under the following electroplating conditions: a current density of 5 A/dm$^2$, a cell voltage of 10 V, and an electrode distance of 30 mm. After the resist agent was removed, the steel sheet was decarburization-annealed and finish-annealed by a normal method.

Samples were obtained from the resultant steel sheets, and the magnetic characteristics thereof were determined. Comparative samples having grooves but no Sn plating and samples having no grooves and no Sn plating were obtained from the same cold-rolled steel sheet coil, and the magnetic characteristics of the comparative samples were also determined.

Figure 3:
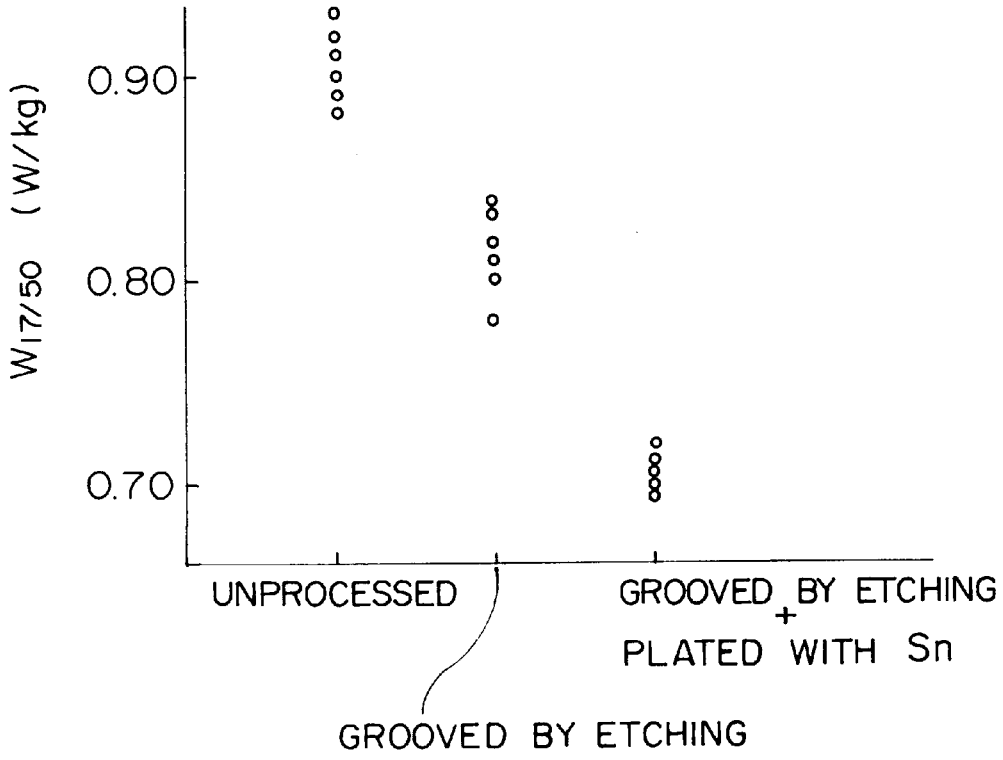
FIG. 3 is a graph showing the results of a second experiment according to the present invention and, more specifically, the iron loss characteristics of sample steel sheets provided with grooves which have been formed by etching and then plated with Sn, sample steel sheets provided with grooves which have been formed by etching but not plated with Sn, and sample steel sheets provided with no groove and no Sn plating.
Figure 4:
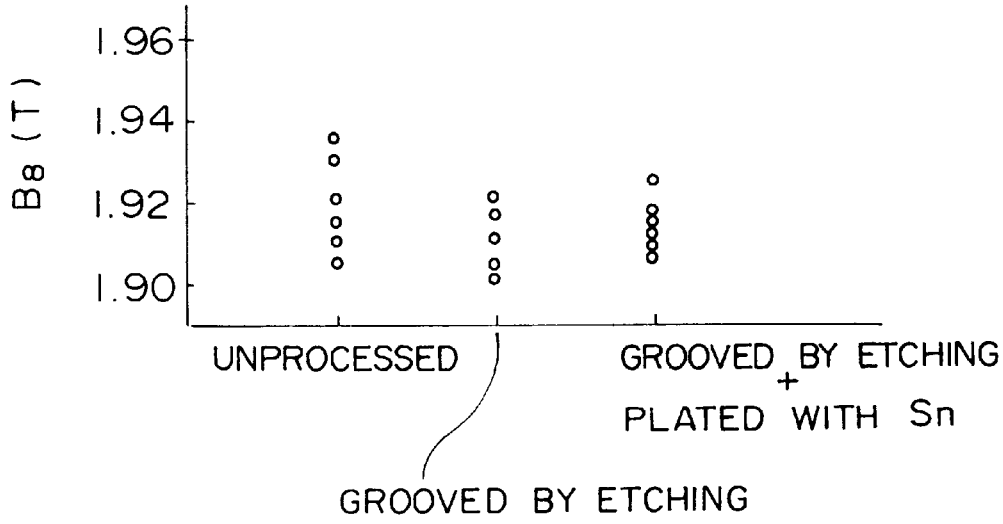
FIG. 4 is a graph showing the results of a second experiment according to the present invention and, more specifically, the magnetic flux density of sample steel sheets provided with grooves which have been formed by etching and then plated with Sn, sample steel sheets provided with grooves which have been formed by etching but not placed with Sn, and sample steel sheets provided with no groove and no Sn plating.
Figure 5:
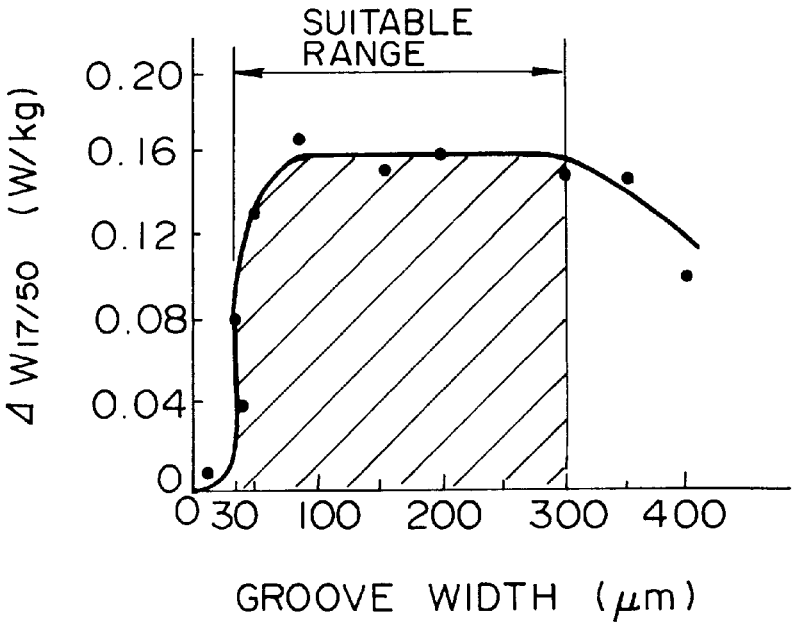
FIG. 5 is a graph indicating the relation between the iron loss reduction $\Delta W_{17/50}$ and the groove width.
Figure 6:
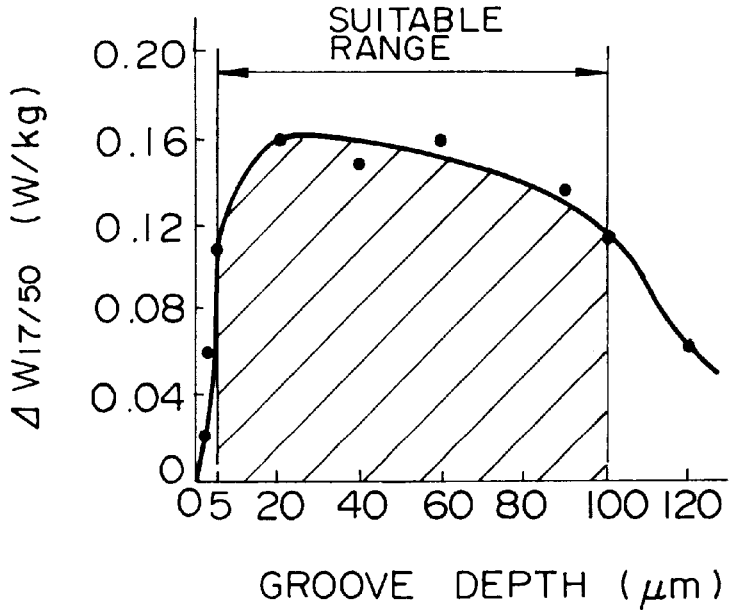
FIG. 6 is a graph indicating the relation between the iron loss reduction $\Delta W_{17/50}$ and the groove depth.
Figure 7:
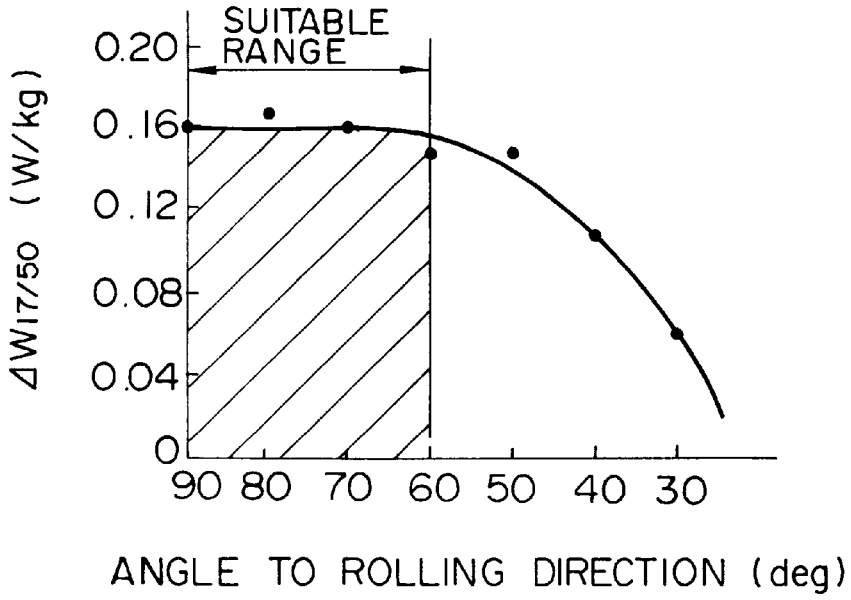
FIG. 7 is a graph indicating the relation between the iron loss reduction $\Delta W_{17/50}$ and the groove angle with respect to the rolling direction.
Figure 8:
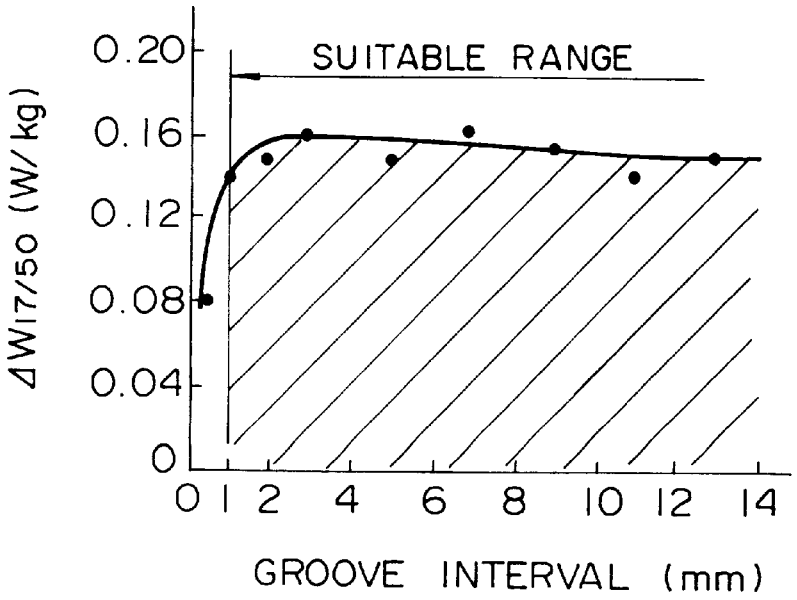
FIG. 8 is a graph indicating the relation between the iron loss reduction $\Delta W_{17/50}$ and the groove interval.

The results are shown in FIG. 3 and FIG. 4. As shown in FIG. 3, samples having grooves and Sn plating thereon achieved lower iron losses than the samples having grooves but no Sn plating. Further, the samples grooved by etching and plated with Sn achieved more favorable and stable iron loss characteristics $W_{17/50}$ (W/kg) than the samples grooved by a ridged roll or an electron beam shown in FIG. 1.

The reasons for this result are not clearly known. However, it is surmised that grooving by a ridged roll or an electron beam creates non-uniform stress in a steel sheet and, thereby, causes non-uniform diffusion of Sn, while grooving by etching does not create such stress in a steel sheet. Incidentally, fine grains were observed in Sn-plated portions. The magnetic characteristics of sample steel sheets having various groove widths, various groove depths, various groove angles with respect to the rolling direction, and various groove intervals measured parallel to the rolling direction, were determined by experiments under substantially the same conditions. As shown in FIGS. 5 to 8, desirable iron loss characteristics were achieved by steel sheets provided with grooves which had widths of about 30–300 $\mu$m and depths of about 5–100 $\mu$m and extended at about 60–90° with respect to the rolling direction and were each spaced from the adjacent one by at least about 1 mm measured parallel to the rolling direction.

The grooves may be formed in various patterns, for example, in the form of continuous straight lines, dashed lines, dotted lines, or wavy lines.

In industrial-scale production, grooves are formed preferably by an electrochemical method, such as electrolytic etching, or a chemical method, such as acid dipping. If electrolytic etching is employed, the electrode distance can be desirably selected as long as the distance allows the cathode and anode to release and take electrons. However, the distance is preferably about 50 mm or shorter to achieve good conductivity. The electrolytic etching solution may be a known solution, such as an NaCl aqueous solution or a KCl aqueous solution, and a preferable current density is about 5–40 A/dm$^2$. If chemical etching, such as acid dipping, is employed, the etching solution may be a solution of $FeCl_3$, $HNO_3$, HCl, or the like.

The grooves may be filled with B and Sb, as well as Sn. The grooves may be suitably filled by various methods, for example, electroplating, electroless plating, and vapor plating such as PVD or CVD. Further, the grooves may be filled by depositing a slurry prepared by mixing water with a thoroughly ground powder of any of the above-mentioned three substances, achieving generally the same advantages. Still further, an oxide or a sulfate of any of the three substances, Sn, B or Sb, may be deposited in the grooves, substantially enhancing the magnetic characteristics of the steel sheet. Examples of the oxide are $SnO_2$, SnO, $B_2O_3$ and $Sb_2O_3$. Examples of the sulfate are $SnSO_4$ and $Sb_2(SO_4)_3$. Although sufficiently good effects can be achieved by this processing performed on one of the sides of a steel sheet, the processing may be performed on both sides.

The grooves filled with an element selected from the group consisting of Sn, B and Sb, or an oxide or a sulfate of the selected element, further reduce iron loss. The reason for this is surmised that linear grooves achieve a demagnetization effect and, further, filling of Sn, B, Sb or the like promotes formation of fine grains without disturbing the orientation of the secondary recrystallized grains.

Because the substance is filled in the grooves, the substance will not come off from the steel sheet even during high-speed conveyance or even during coiling.

The following are examples which factually demonstrate the great reduction in iron loss achieved when a steel sheet is produced in accordance with aspects of the present invention.

EXAMPLE 1

A silicon steel slab containing 0.043% C, 3.36% Si, 0.070% Mn, 0.013% Mo, 0.019% Se, and 0.023% Sb was heated and maintained at 1360° C. for 3 hours before it was hot-rolled to obtain a sheet having a thickness of 2.4 mm. The hot-rolled sheet was cold-rolled twice, intervened by intermediate annealing at 970° C. for 3 minutes so as to obtain a cold-rolled sheet having a thickness of 0.23 mm. Sample steel sheets were obtained by shearing the cold-rolled sheet in coil.

Prior to the final annealing step, a resist ink was applied as a masking agent to the sample steel sheets so as to leave uncoated linear areas, that is, areas not covered with the resist ink, extending perpendicularly to the rolling direction and having a width of 0.2 mm with a space of 3 mm left between adjacent uncoated areas. The steel sheets were then electrolytically etched in a NaCl aqueous solution under the following conditions: a current density of 10 A/dm$^2$, an electrolysis time of 20 seconds, and an electrode distance of 30 mm, thereby forming grooves having a depth of about 20 $\mu$m in the uncoated areas, that is, the steel exposed areas. After the resist agent was removed, the grooves of the steel sheets were filled by separately applying thereto with brushes slurries of Sn, B and Sb prepared by mixing thoroughly-ground powders of those substances with water.

The thus-processed steel sheets were decarburization-annealed, finishing-annealed, and then annealed for flattening.

Comparative samples were obtained from the same cold-rolled coil, from portions adjacent to the portions for the sample steel sheets, which were then grooved as described above. The comparative samples were processed similarly to the grooved steel sheets, except that the comparative samples were not processed for grooving and filling.

The magnetic characteristics of the sample steel sheets and the comparative sample steel sheets are shown in Table 1.

TABLE 1

| Sample | W17/50 (W/kg) | B8 (T) |
|---|---|---|
| Sn Slurry-coated | 0.72 | 1.91 |
| B Slurry-coated | 0.73 | 1.92 |
| Sb Slurry-coated | 0.73 | 1.92 |
| Groove Only | 0.79 | 1.92 |
| No-grooved, Non-deposited | 0.88 | 1.93 |

EXAMPLE 2

A silicon steel slab having generally the same composition as the slab used in Example 1 was processed in generally the same manner as in Example 1, up to the resist-printing step. The resist-printed steel sheets were dipped in 30% $HNO_3$ solution for 15–30 seconds to form grooves having a depth of about 20 $\mu$m. The groove portions were electroplated with Sn and Sb, respectively. The Sn electroplating was performed by using a plating bath containing 60 g of stannous sulfate, 80 g of sulfuric acid, 100 g of stannous cresolsulfonate, 1.0 g of β-naphthol and 2 g of gelatin per 1 liter of ion-exchanged water, at a bath temperature of 30° C., under the following electroplating conditions: a current density of 5 A/dm$^2$, an electrolysis time of 5–20 seconds, and an electrode distance of 30 mm.

The Sb electroplating was performed by using a plating bath containing 52 g of antimony trioxide, 150 g of potassium citrate and 180 g of citric acid per 1 liter of ion-exchanged water, at a bath temperature of 55° C., under the following electroplating conditions: a current density of 3.5 A/dm$^2$, an electroplating time of 5–20 seconds, and an electrode distance of 30 mm.

After plating, the sample steel sheets were decarburization-annealed and finish-annealed by a normal method.

Comparative samples were obtained from the same cold-rolled coil, from portions adjacent to the portions for the grooved sample steel sheets. The comparative samples were processed similarly to the grooved steel sheets, except that the comparative samples were not processed for grooving and filling, thus obtaining comparative samples having no groove and comparative samples having grooves but no plating.

The magnetic characteristics of the sample steel sheets and the comparative sample steel sheets are shown in Table 2.

TABLE 2

| Sample | W17/50 (W/kg) | B8 (T) |
|---|---|---|
| Sn Electroplated | 0.71 | 1.91 |
| Sb Electroplated | 0.72 | 1.92 |
| Groove Only | 0.79 | 1.92 |
| Non-grooved, Non-deposited | 0.86 | 1.93 |

EXAMPLE 3

A silicon steel slab having generally the same composition as the slab used in Example 1 was processed in generally the same manner as in Example 1, up to the final cold-rolling step. After the cold-rolled steel sheet was sheared into sample steel sheets, a resist ink was applied as a masking agent to the sample steel sheets so as to leave uncoated areas, that is, areas not covered with the resist ink, extending in the form of a dashed line (the dash interval being 0.2 mm) perpendicularly to the rolling direction and having a width of 0.2 mm with a space of 3 mm left between adjacent uncoated areas. The steel sheets were then electrolytically etched in a NaCl aqueous solution under the following conditions: a current density of 10 A/dm$^2$, an electrolysis time of 20 seconds, and an electrode distance of 30 mm, thereby forming grooves having a depth of about 20 $\mu$m in the uncoated areas, that is, the steel exposed areas. The grooves of the sample steel sheets were respectively electroplated with Sn and Sb under generally the same manner and conditions as in Example 2. After the resist agent was removed from the steel sheets, the steel sheets were decarburization-annealed and finish-annealed by a normal method.

Comparative samples were obtained from the same cold-rolled coil, from portions adjacent to the portions for the grooved sample steel sheets. The comparative samples were processed similarly to the grooved steel sheets, except that the comparative samples were not processed for grooving and filling, thus obtaining comparative samples having no groove and comparative samples having grooves but no plating.

The magnetic characteristics of the sample steel sheets and the comparative sample steel sheets are shown in Table 3.

TABLE 3

| Sample | W17/50 (W/kg) | B8 (T) |
|---|---|---|
| Sn Electroplated (Dash-grooved) | 0.72 | 1.92 |
| Sb Electroplated (Dash-grooved) | 0.72 | 1.92 |
| Groove Only | 0.80 | 1.92 |
| Non-grooved, Non-deposited | 0.87 | 1.93 |

EXAMPLE 4

A silicon steel slab containing 0.073% C, 3.36% Si, 0.070% Mn, 0.019% Se, 0.025% Al, 0.00090% N, and 0.023% Sb was heated and maintained at 1400° C. for one hour before it was hot-rolled to obtain a sheet having a thickness of 2 mm. After the hot-rolled coil was annealed at 1000° C. for one minute, the steel sheet was cold-rolled twice intervened by intermediate annealing at 1000° C. for one minute so as to obtained a cold-rolled sheet having a thickness of 0.23 mm. Sample steel sheets were obtained by shearing the cold-rolled coil.

Prior to the final annealing step, a resist ink was applied as a masking agent to the sample steel sheets so as to leave uncoated linear areas, that is, areas not covered with the resist ink, extending perpendicularly to the rolling direction and having a width of 0.2 mm with a space of 3 mm left between adjacent uncoated areas. The steel sheets were then electrolytically etched in a NaCl aqueous solution under the following conditions: a current density of 10 A/dm$^2$, an electrolysis time of 20 seconds, and an electrode distance of 30 mm, thereby forming grooves having a depth of about 20 $\mu$m in the uncoated areas, that is, the steel exposed areas. After the resist agent was removed, the grooves of the steel sheets were filled by respectively applying thereto with brushes slurries of Sn, B and Sb prepared by mixing thoroughly ground powders of those substances with water.

The thus-processed steel sheets were decarburization-annealed, finishing-annealed, flattening-annealed, and then annealed for removing stress at 800° C. for 3 hours.

Comparative samples were obtained from the same cold-rolled coil, from portions adjacent to the portions for the sample steel sheets which were then grooved as described above. The comparative samples were processed similarly to the grooved steel sheets, except that the comparative samples were not processed for grooving and filling.

The magnetic characteristics of the sample steel sheets and the comparative sample steel sheets are shown in Table 4.

TABLE 4

| Sample | W17/50 (W/kg) | B8 (T) |
|---|---|---|
| Sn Slurry-coated | 0.68 | 1.94 |
| B Slurry-coated | 0.67 | 1.94 |
| Sb Slurry-coated | 0.68 | 1.94 |
| Groove Only | 0.73 | 1.94 |
| Non-grooved, Non-deposited | 0.90 | 1.95 |

EXAMPLE 5

A silicon steel slab having generally the same composition as the slab used in Example 4 was processed in generally the same manner as in Example 4, up to the resist-printing step. The resist-printed steel sheets were dipped in 30% $HNO_3$ solution for 15–30 seconds to form grooves having a depth of about 20 $\mu$m. The groove portions were electroplated with Sn and Sb, respectively. The Sn electroplating was performed by using a plating bath containing 60 g of stannous sulfate, 80 g of sulfuric acid, 100 g of stannous cresolsulfonate, 1.0 g of β-naphthol and 2 g of gelatin per 1 liter of ion-exchanged water, at a bath temperature of 30° C., under the following electroplating conditions: a current density of 5 A/dm$^2$, an electrolysis time of 5–20 seconds, and an electrode distance of 30 mm.

The Sb electroplating was performed by using a plating bath containing 52 g of antimony trioxide, 150 g of potassium citrate and 180 g of citric acid per 1 liter of ion-exchanged water, at a bath temperature of 55° C., under the following electroplating conditions: a current density of 3.5 A/dm$^2$, an electroplating time of 5–20 seconds, and an electrode distance of 30 mm.

After plating, the sample steel sheets were decarburization-annealed and finish-annealed by a normal method.

Comparative samples were obtained from the same cold-rolled coil, from portions adjacent to the portions for the grooved sample steel sheets. The comparative samples were processed similarly to the grooved steel sheets, except that the comparative samples were not processed for grooving and filling, thus obtaining comparative samples having no grooves and comparative samples having grooves but no plating.

The magnetic characteristics of the sample steel sheets and the comparative sample steel sheets are shown in Table 5.

TABLE 5

| Sample | W17/50 (W/kg) | B8 (T) |
|---|---|---|
| Sn Electroplated | 0.67 | 1.93 |
| Sb Electroplated | 0.67 | 1.94 |
| Groove Only | 0.72 | 1.94 |
| Non-grooved, Non-deposited | 0.88 | 1.95 |

EXAMPLE 6

A silicon steel slab having generally the same composition as the slab used in Example 4 was processed in generally the same manner as in Example 4, up to the final cold-rolling step. After the cold-rolled steel sheet was sheared into sample steel sheets, a resist ink was applied as a masking agent to the sample steel sheets so as to leave uncoated areas, that is, areas not covered with the resist ink, extending in the form of a dashed line (the dash interval being 0.2 mm) perpendicularly to the rolling direction and having a width of 0.2 mm with a space of 3 mm left between adjacent uncoated areas. The steel sheets were then electrolytically etched in a NaCl aqueous solution under the following conditions: a current density of 10 A/dm$^2$, an electrolysis time of 20 seconds, and an electrode distance of 30 mm, thereby forming grooves having a depth of about 20 $\mu$m in the uncoated areas, that is, the steel exposed areas. The grooves of the sample steel sheets were respectively electroplated with Sn and Sb under generally the same manner and conditions as in Example 4. After the resist agent was removed from the steel sheets, the steel sheets were decarburization-annealed and finish-annealed by a normal method.

Comparative samples were obtained from the same cold-rolled coil, from portions adjacent to the portions for the grooved sample steel sheets. The comparative samples were processed similarly to the grooved steel sheets, except that the comparative samples were not processed for grooving and filling, thus obtaining comparative samples having no groove and comparative samples having grooves but no plating.

The magnetic characteristics of the sample steel sheets and the comparative sample steel sheets are shown in Table 6.

TABLE 6

| Sample | W17/50 (W/kg) | B8 (T) |
|---|---|---|
| Sn Electroplated (Dash-grooved) | 0.68 | 1.94 |
| Sb Electroplated (Dash-grooved) | 0.68 | 1.94 |
| Groove Only | 0.72 | 1.94 |
| Non-grooved, Non-deposited | 0.87 | 1.95 |

EXAMPLE 7

A silicon steel slab having generally the same composition as the slab used in Example 4 was processed in generally the same manner as in Example 4, up to the resist-printing step. The resist-printed steel sheets were dipped in 30% $HNO_3$ solution for 15–30 seconds to form grooves having a depth of about 20 $\mu$m. After the resist agent was removed, the grooves of the steel sheets were filled with slurry mixtures of water and $SnO_2$, $SnSO_4$, $B_2O_3$ and $Sb_2O_3$. Subsequently, the steel sheets were decarburization-annealed and then finish-annealed.

Comparative samples were obtained from the same cold-rolled coil, from portions adjacent to the portions for the grooved sample steel sheets. The comparative samples were processed to obtain comparative samples having no groove and comparative samples having grooves but no deposition of a slurry of $SnO_2$, $SnSO_4$, $B_2O_3$ or $Sb_2O_3$.

The magnetic characteristics of the sample steel sheets and the comparative sample steel sheets are shown in Table 7.

TABLE 7

| Sample | W17/50 (W/kg) | B8 (T) |
|---|---|---|
| $SnO_2$ Slurry-coated | 0.67 | 1.94 |
| $SnO_4$ Slurry-coated | 0.67 | 1.93 |
| $B_2O_3$ Slurry-coated | 0.69 | 1.93 |
| $Sb_2O_3$ Slurry-coated | 0.68 | 1.94 |
| Grooved Only | 0.74 | 1.94 |
| Non-grooved, Non-deposited | 0.89 | 1.95 |

As described above, the method of the present invention produces a grain-oriented electromagnetic steel sheet having good magnetic characteristics. Further, according to the method of the present invention, a coating substance is filled in the grooves of a steel sheet, and thus the substance will not come off the steel sheet even during high-speed conveyance or coiling of the steel sheet.

While the present invention has been described with reference to what are presently considered to be the preferred embodiments, it is to be understood that the invention is not limited to the disclosed embodiments. To the contrary, the invention is intended to cover various modifications obvious to one of ordinary skill in the art and equivalent arrangements included within the spirit and scope of the appended claims.

What is claimed is:

1. A method of producing a low iron loss grain-oriented electromagnetic steel sheet comprising the steps of:

hot rolling an electromagnetic steel;

cold rolling the hot rolled steel sheet once, or at least two times including intermediate annealing and forming a cold rolled sheet;

annealing the cold rolled steel sheet for decarburization;

after cold rolling and before finish annealing, forming linear grooves in the steel sheet without applying non-uniform stress to the steel sheet by a method selected from the group consisting of electrochemical and chemical;

filling said linear grooves with an element or compound of said element, said element being selected from the group consisting of Sn, B and Sb; and promoting formation of fine grains in said steel sheet without disturbing orientation of secondary recrystallized grains in said steel sheet during finish-annealing of the steel sheet.

2. A method according to claim 1, wherein each of said linear grooves has a width of about 30–300 $\mu$m and a depth of about 5–100 $\mu$m, and extends at an angle of about 60–90° to the rolling direction, and is apart from adjacent grooves by at least 1 mm.

3. The method defined in claim 1 wherein said compound is selected from the group consisting of oxides and sulfates.

4. A method according to claim 1, wherein said electromagnetic steel sheet contains about 0.01–0.10 wt % C, about 2.0–4.5 wt % Si, and about 0.02–0.12 wt % Mn.

5. A method according to any of claims 1–4, wherein said electromagnetic steel sheet contains an inhibitor.

6. A method according to claim 5, wherein one or more of said inhibitor is selected from the group consisting of MnS, MnSe and AlN containing inhibitors, containing about 0.005–0.06 wt % S, about 0.005–0.06 wt % Se, or about 0.005–0.10 wt % Al and 0.004–0.015 wt % N, respectively, applied separately or in combination.

7. A method of producing a low iron loss grain-oriented electromagnetic steel sheet according to claim 5, wherein one or more of said inhibitor is selected from the group consisting of about 0.01–0.15 wt % of Cu, Sn or Cr, about 0.005–0.1 wt % of Ge, Sb, Mo, Te or Bi, and about 0.01–0.2 wt % P, applied separately or in combination.

8. A method of producing a low iron loss grain oriented electromagnetic steel sheet, wherein said electromagnetic steel sheet contains about 0.01–0.10 wt % C, about 2.0–4.5 wt % Si, and about 0.02–0.12 wt % Mn, which comprises the steps of:

hot rolling an electromagnetic steel;

cold rolling the hot rolled steel into a cold rolled steel sheet;

annealing the cold rolled steel sheet for decarburization;

after cold rolling and before finish annealing, forming linear grooves in the steel sheet without applying non-uniform stress to the steel sheet by an electrochemical or chemical method;

filling said linear grooves with an element selected from the group consisting of Sn, B and Sb, or a compound thereof; and promoting formation of fine grains in said steel sheet without disturbing orientation of secondary recrystallized grains in said steel sheet during finish-annealing of the steel sheet.

9. A method of producing a low iron loss grain-oriented electromagnetic steel sheet according to claim 8, wherein each of said linear grooves has a width of about 30–300 $\mu$m and a depth of about 5–100 $\mu$m, and extends at about 60–90° to the rolling direction, and is apart from the adjacent groove by at least 1 mm.

10. A method of producing a low iron loss grain-oriented electromagnetic steel sheet according to either claim 8 or 9, wherein said electromagnetic steel sheet contains an inhibitor.

11. A method of producing a low iron loss grain-oriented electromagnetic steel sheet according to claim 10, wherein one or more of said inhibitor is selected from the group consisting of MnS, MnSe and AlN, containing about 0.005–0.06 wt % S, about 0.005–0.06 wt % Se, or about 0.005–0.10 wt % Al and about 0.004–0.015 wt % N, respectively, applied separately or in combination.

12. A method of producing a low iron loss grain-oriented electromagnetic steel sheet according to claim 10, wherein one or more of said inhibitor is selected from the group consisting of about 0.01–0.15 wt % of Cu, Sn or Cr, about 0.005–0.1 wt % of Ge, Sb, Mo, Te or Bi, and about 0.01–0.2 wt % P, to be used separately or in combination.

13. A method of producing a low iron loss grain oriented electromagnetic steel sheet, wherein said electromagnetic steel sheet contains about 0.01–0.10 wt % of C, about 2.0–4.5 wt % of Si, and about 0.02–0.12 wt % of Mn, and an inhibitor, which comprises the steps of:

hot rolling an electromagnetic steel;

cold rolling the hot rolled steel once or at least two times including intermediate annealing and forming a cold rolled steel sheet;

annealing the cold rolled steel sheet for decarburization;

after cold rolling and before finish annealing, forming linear grooves in the steel sheet without applying non-uniform stress to the steel sheet by either of an electrochemical or chemical treatment;

filling said linear grooves with an element selected from the group consisting of Sn, B and Sb, or an oxide or a sulfate of an element selected therefrom, said linear grooves having a width of about 30–300 μm and a depth of about 5–100 μm, and extending at about 60–90° to the rolling direction, said grooves being separated from adjacent grooves by at least 1 mm; and promoting formation of fine grains in said decarburized steel sheet without disturbing orientation of secondary recrystallized grains in said decarburized steel sheet during finish-annealing of the decarburized steel sheet.

14. A method of producing a low iron loss grain-oriented electromagnetic steel sheet according to claim 13, wherein one or more of said inhibitor is selected from the group consisting of Mns, MnSe and AlN, containing about 0.05–0.06 wt % of S, about 0.005–0.06 wt % of Se, or about 0.005–0.10 wt % of Al and about 0.004–0.015 wt % of N, respectively, separately or in combination.

15. A method of producing a low iron loss grain-oriented electromagnetic steel sheet according to claim 14, wherein one or more of said inhibitor is selected from the group consisting of about 0.01–0.15 wt % of Cu, Sn or Cr, about 0.005–0.1 wt % of Ge, Sb, Mo, Te or Bi, and about 0.01–0.2 wt % of P, separately or in combination.

16. A cold-rolled low iron loss grain-oriented electromagnetic steel sheet containing about 0.01 to 0.10 wt % C, about 2.0 to 4.5 wt % Si, and about 0.02 to 0.12 wt % Mn, said sheet having oriented secondary recrystallized grains and a plurality of etched linear grooves, said grooves being arranged substantially perpendicular to the rolling direction of said sheet and without formation of non-uniform stress in said sheet, said grooves being filled with an element or compound of said element, said element being selected from the group consisting of Sn, B and Sb to promote formation of fine grains in said sheet without disturbing the orientation of said secondary recrystallized grains.

17. A low iron loss grain-oriented electromagnetic steel sheet according to claim 16, wherein each of said linear grooves has a width of about 30 to 300 μm and a depth of about 5 to 100 μm, and extends at about 60 to 90° to the rolling direction, of said sheet, and is separated from the adjacent groove by about 1 mm.

18. A low iron loss grain-oriented electromagnetic steel sheet according to either of claim 16 or 17, wherein said electromagnetic steel sheet contains an inhibitor.

19. A low iron loss grain-oriented electromagnetic steel sheet according to claim 18, wherein one or more of said inhibitor is selected from the group consisting of Mns, MnSe and AlN-containing inhibitors, containing about 0.005 to 0.06 wt % S, about 0.005 to 0.06 wt % Se, or about 0.005 to 0.10 wt % Al, and about 0.004 to 0.15 wt % N, respectively, applied separately or in combination.

20. A low iron loss grain-oriented electromagnetic steel sheet according to claim 18, wherein one or more of said inhibitor is selected from the group consisting of 0.1 to 0.15 wt % of Cu, Sn or Cr, about 0.005 to 0.1 wt % of Ge, Sb, Mo, Te or Bi, and about 0.01 to 0.2 wt % present separately or in combination.

* * * * *

UNITED STATES PATENT AND TRADEMARK OFFICE

CERTIFICATE OF CORRECTION

PATENT NO. : 6,228,182 B1
DATED : May 8, 2001
INVENTOR(S) : Nakano et al.

It is certified that error appears in the above-identified patent and that said Letters Patent is hereby corrected as shown below:

Column 8,
Line 66, please change “0.073%” to -- 0.03% --.

Column 9,
Line 62, please change “3.5” to -- 5 --.

Signed and Sealed this

Eleventh Day of June, 2002

*Attest:*

*Attesting Officer*

JAMES E. ROGAN
*Director of the United States Patent and Trademark Office*